US005769660A

United States Patent [19]

Sakurai et al.

[11] Patent Number: 5,769,660

[45] Date of Patent: Jun. 23, 1998

[54] CONNECTOR HOUSING

[75] Inventors: Toshikazu Sakurai, Yokkaichi; Satoru Aoki, Wako, both of Japan

[73] Assignees: Sumitomo Wiring Systems, Ltd.; Honda Giken Kogyo K.K., both of Japan

[21] Appl. No.: 788,281

[22] Filed: Jan. 24, 1997

[30] Foreign Application Priority Data

Jan. 29, 1996 [JP] Japan ..... 8-013046

[51] Int. Cl.[6] ..... H01R 13/52

[52] U.S. Cl. ..... 439/521

[58] Field of Search ..... 439/521, 557, 439/552, 536, 554, 544, 562, 570, 571, 367

[56] References Cited

U.S. PATENT DOCUMENTS 3,530,426 9/1970 Snyder, Jr. ..... 439/557

4,687,276 8/1987 Stockmaster ..... 439/557

5,372,523 12/1994 Sakatani et al. ..... 439/552

5,595,504 1/1997 Muller ..... 439/521

*Primary Examiner*—Hien Vu

*Attorney, Agent, or Firm*—Jordan B. Bierman; Bierman, Muserlian and Lucas

[57] ABSTRACT

Water which drops on an upper surface of a connector housing will often flow through a rear side of the housing onto electric wires. A part of the water enters a terminal containing chamber. This invention prevents penetration of the water. A connector includes a connector housing (10) provided with a terminal containing chamber (11*a*) which is open to a rear side of the housing. The housing (10) is provided with a visor (13) which extends from an upper surface of the housing to an upper part of the rear side to cover an upper part of an opening of the chamber (11*a*). Water drops (D) from the upper surface of the housing (10) cannot flow down on electric wires (20) drawn out from the terminal containing chamber (11*a*) and thus cannot enter the chamber (11*a*) through the wires (20).

5 Claims, 3 Drawing Sheets

CONNECTOR HOUSING

BACKGROUND OF THE INVENTION

This invention relates to a connector housing and in more particular relates to a connector housing suitable for use in a panel connector to be attached to a panel.

For convenience of explanation, a conventional panel connector will be described below by referring to FIGS. 5 and 6. FIG. 5 is a perspective view of the conventional panel connector. FIG. 6 is a side elevational view of the panel connector shown in FIG. 5, illustrating a state in which the connector is attached to a car body panel.

Heretofore, a waiting-for connector which is attached to a panel near a door of an automotive vehicle, as shown in FIGS. 5 and 6, has been known as the panel connector.

In the drawings, a panel 1 is provided with a rectangular window 1*a* adapted to mount a connector. The connector includes a connector housing 2 comprising a terminal holding portion 3 which defines a terminal containing chamber 3*a,* and a hood portion 4 adapted to come into contact with an inner periphery of the window 1*a*. The hood portion 4 is provided on an outer periphery of its distal end with a stepped section 4*a* which is adapted to come into contact with a rear side of the panel 1 and with a pair of lock arms 4*b* each having a wedge-like projection 4*b*1 which is adapted to slide over the peripheral edge of the window 1*a*.

When the distal end of the hood portion 4 is inserted into the window 1*a,* the hood portion 4 stops on the panel 1 with the outer periphery of the distal end coming into close contact with the inner peripheral edge of the window 1*a* and with the stepped section 4*a* coming into contact with the rear side of the panel 1. Then, the lock arm 4*b* locks the connector housing 2 on the panel 1 with the projection 4*b*1 sliding over the peripheral edge of the window 1*a*.

On the other hand, the terminal containing chamber 3*a* has an opening at the rear side of the connector housing 2. Male terminals 5 press-connected to distal ends of electric wires 6 are inserted through the rear opening into the chamber 3*a*. Consequently, the electric wires 6 are drawn out rearward from the connector 2.

The conventional panel connector having the connector housing has encountered the following problems.

In the case where the connector 2 is attached to a car body panel of an automotive vehicle, water drops D due to condensation in the vehicle fall on an upper surface of the connector housing and flow down the side walls or front and rear walls. Some of the water which falls on the electric wires 6 enters the terminal containing chamber 3*a*.

SUMMARY OF THE INVENTION

An object of the present invention is to provide a connector housing which prevents water due to condensation from entering a terminal containing chamber through electric wires and which has a simple structure.

In order to achieve the above object, a connector housing in accordance with the present invention comprises a terminal containing chamber having an opening in a rear side thereof; and a visor extending from an upper surface of said housing toward a rear part thereof to cover an upper part of the opening.

In the connection housing, the visor is inclined upwardly from a proximal end at the upper surface of the housing to a distal end above the upper part of the opening.

Further, in the connector housing, the visor is provided on the upper surface thereof with a recess and ridge structure for guiding water along the surface.

In the connector housing having the above construction in accordance with the present invention, when the terminal connected to an end of the electric wire is inserted into the terminal containing chamber, the electric wire extends out of the opening in the chamber. Since the visor extends rearward from the upper surface of the connector housing to a space above the upper part of the opening, the water which falls on the upper surface of the housing does not flow into the rear opening directly.

Also, in the connector housing, since the visor is formed into an upward slope to the rear side, the water on the upper surface of the visor flows toward the front side and thus hardly falls on the electric wires. In the case where a car body is inclined down to a rear side, almost all the water on the upper surface of the conventional connector housing having no visor flows to the rear side, but in the connector housing of the present invention hardly any water on the surface flows rearward, so long as the rear end is higher than the front end.

Further, the ribs or ridges on the visor can direct the water to a space having no problem in wetness.

According to the present invention, it is possible to provide a connector housing which is simple in construction and can prevent water from entering the interior through the electric wires.

Hardly any of the water on the housing falls on the electric wires, not only in a normal condition but also in an inclined condition.

Auxiliary means such as recesses, ribs, or ridges can control the flow path of water so that the water does not fall on the electric wires.

DETAILED DESCRIPTION OF THE PREFERRED EMBODIMENTS

Figure 1:
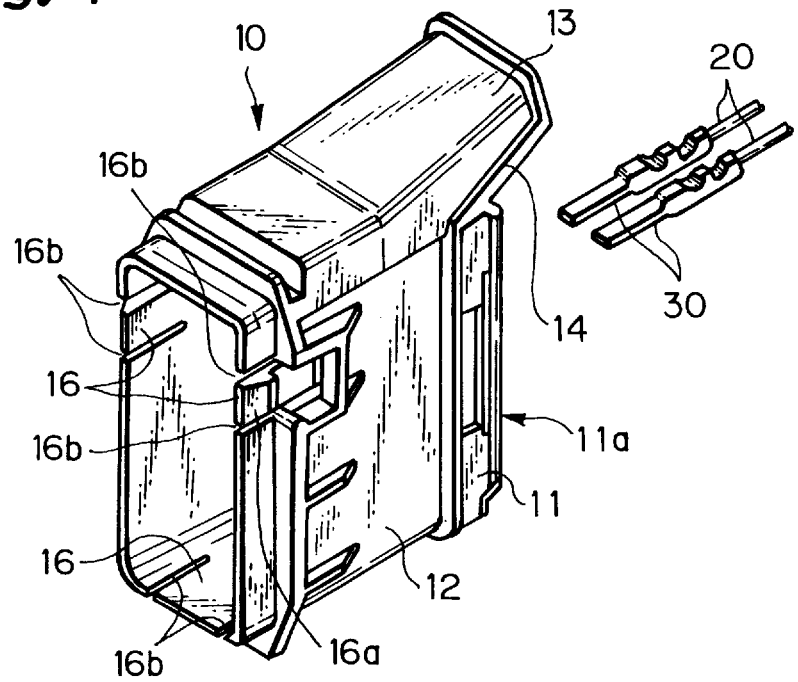
FIG. 1 is a perspective view of a panel connector provided with an embodiment of a connector housing in accordance with the present invention.

Referring now to the drawings, embodiments of a connector housing in accordance with the present invention will be explained below.

Figure 2:
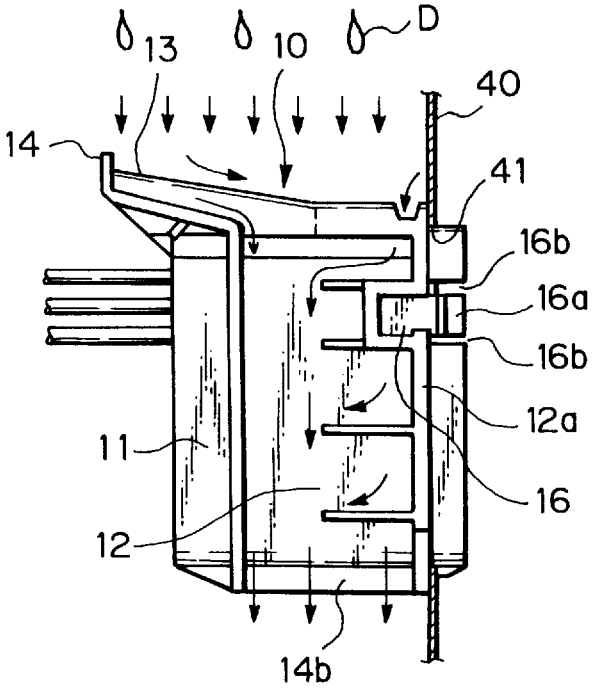
FIG. 2 is a side elevational view of the panel connector shown in FIG. 1, illustrating a state in which the connector is attached to a panel of a car body.

FIG. 1 is a perspective view of a panel connector which is to be attached to a panel and has a connector housing of the present invention. FIG. 2 is a side elevational view of the panel connector which is attached to a car body panel of an automotive vehicle.

In FIGS. 1 and 2, a connector housing 10, which constitutes a panel connector, is formed into a box-like configuration and is provided on its rear side with a terminal containing portion 11 and on its front side with a hood portion 12. The terminal containing portion 11 is provided in its interior with a terminal containing chamber 11*a*. The terminal containing chamber 11*a* has openings at the rear side of the connector housing 10 and at the interior of the hood portion 12. A male terminal 30 which is press-connected to an end of an electric wire 20 is inserted into the terminal containing chamber 11*a* through the rear opening. When the insertion of the male terminal 30 has been completed, the electric wire 20 comes out of the terminal containing chamber 11*a* through the rear opening.

Although the connector housing of the present invention is applied to the panel connector in the above embodiment, the connector housing may be applied to any type of connector provided with the terminal containing chamber 11*a* which is open at the rear side. It should be noted that the word "rear side" is used for convenience of explanation and may be changed to a "lateral side" if the electric wires are drawn out of the lateral opening in the housing on account of a special configuration of a terminal. In addition, a female terminal may be substituted for a male terminal.

The hood portion 12 is provided on its upper surface with a visor 13 which extends upward to a rear side. The visor 13 is formed to cover a space above an upper part of the rear opening in the terminal containing portion 11 and is provided on the end periphery with a rib 14 which constitutes a ridge structure. The rib 14 is inclined down to a front side and is lowered straight onto the outer periphery of the hood portion 12, as shown in FIG. 2, so that the water on the visor 13 flows to the front side and does not fall down directly from the lateral sides of the visor 13.

The visor 13 may take any configuration so long as it covers the space above the upper part of the rear opening in the terminal containing portion 11, although the visor is formed together with the upper surface of the hood portion 12 in this embodiment. For example, the visor 13 may be separated from the hood portion 12 or may be formed into an umbrella shape. A trough 14*c* shown in FIG. 3 may be provided on the visor 13 in place of the rib 14 shown in FIG. 1. The trough 14*c* can improve the water flow. The rib 14*c* may include slant ribs 14*a* provided on the center parts of the side surfaces of the visor 13 and hood portion 12 as well as the rib on the peripheral edge of the visor 13, as shown in FIG. 4. The slant ribs 14*a* will enhance the water flow toward the front side. In the case where a single rib 14 cannot control the water flow sufficiently, a combination of several ribs 14 will be able to control it. The recess and ridge structure on the visor may include ridges, grooves, or recesses as well as the rib 14.

In this embodiment, the connector housing 10 is also provided on its bottom surface with a rib 14*b*. The water on the housing 10 flows along the rib 14*b* and falls down from the lowest end, thereby preventing the water from entering the hood portion 12 through the bottom surface. The hood portion 12 is provided on its front end with a flange 12*a* which extends generally around the outer periphery of the hood portion 12. When a front end of the hood portion 12 is pushed into a window 41 in a car body panel 40 of an automotive vehicle, the flange 12*a* comes into contact with a peripheral edge of the window 41. The hood portion 12 is provided on its upper parts of opposite lateral sides and on its intermediate part of the bottom surface with lock arms 16 having projections 16*a* which project outwardly. When the projections 16*a* slide over the edge of the window 41 from the inside of the window, the lock arms 16 lock the housing 10 on the panel 40. Since the lock arms 16 are not directed upwardly and thus slits 16*b* in both sides of the lock arms 16 are not directed upwardly, hardly any water on the hood portion 12 enters the interior of the hood portion 12 through the slits 16*b*.

Next, an operation of the above embodiment will be explained below.

When the front end of the hood portion 12 is inserted into the window 41 in the car body panel 40, the lock arms 16 on the opposite lateral sides and the bottom surface are pushed into the window 41 while being deflected inwardly. When the flange 12*a* of the hood portion 12 abuts on the rear peripheral edge of the window 41, the projections 16*a* on the lock arms 16 just slide over the edge of the window 41, thereby locking the hood portion 12 on the panel 40.

In a normal condition, the connector housing 10 is mounted on the panel 40 horizontally and thus the hood portion 12 is directed horizontally. In the case where water drops D due to condensation or leakage from a sunroof fall on the connector housing 10, some water drops D are received on the upper surface of the hood portion 12 or the visor 13. Some water on the visor 13 will flow to the hood portion 12 on account of the downward slope. The remaining water on the visor 13 will flow on the lateral sides thereof and reach the rib 14 on the edge thereof. The water which reaches the rib 14 will flow to the hood portion 12. Consequently, any water drops D will not fall on the electric wires 20 near the rear opening in the terminal containing chamber 11*a*, thereby preventing the water from entering the terminal containing chamber 11*a*.

Figure 3:
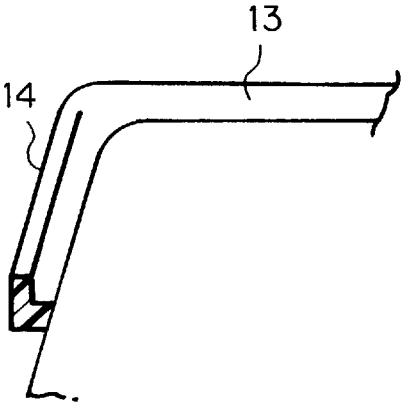
FIG. 3 is an enlarged view of a main part of a visor, illustrating an alteration of a rib of the visor.
Figure 4:
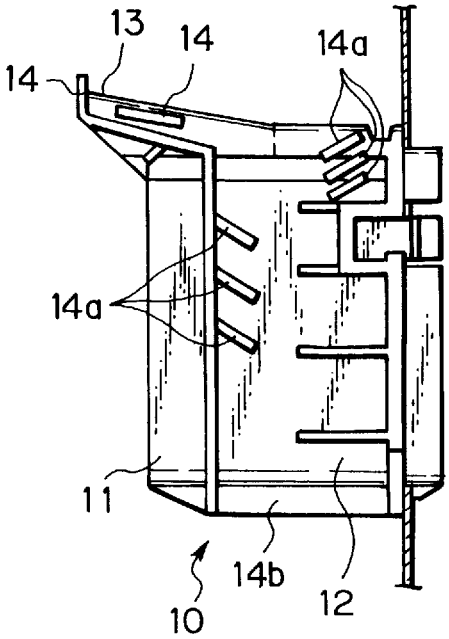
FIG. 4 is a side elevational view of the panel connector with an altered rib of the visor.
Figure 5:
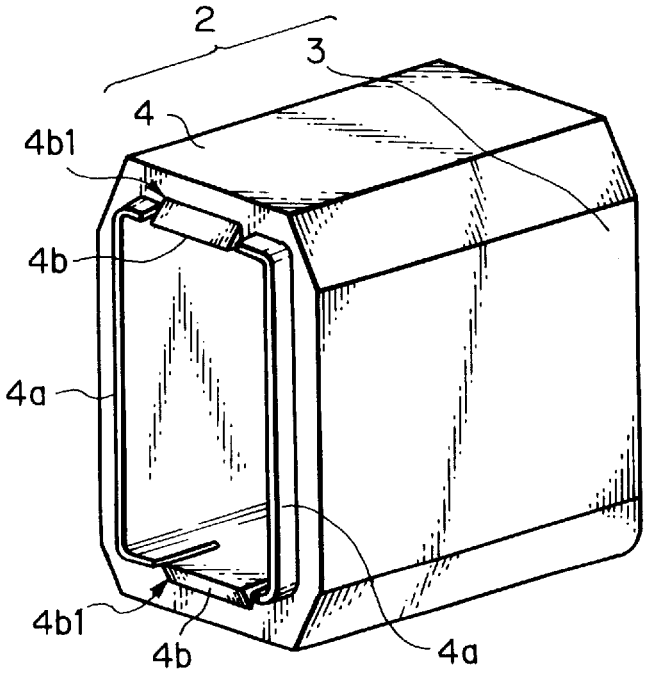
Fig. 5 PRIOR ART
FIG. 5 is a perspective view of a conventional panel connector.
Figure 6:
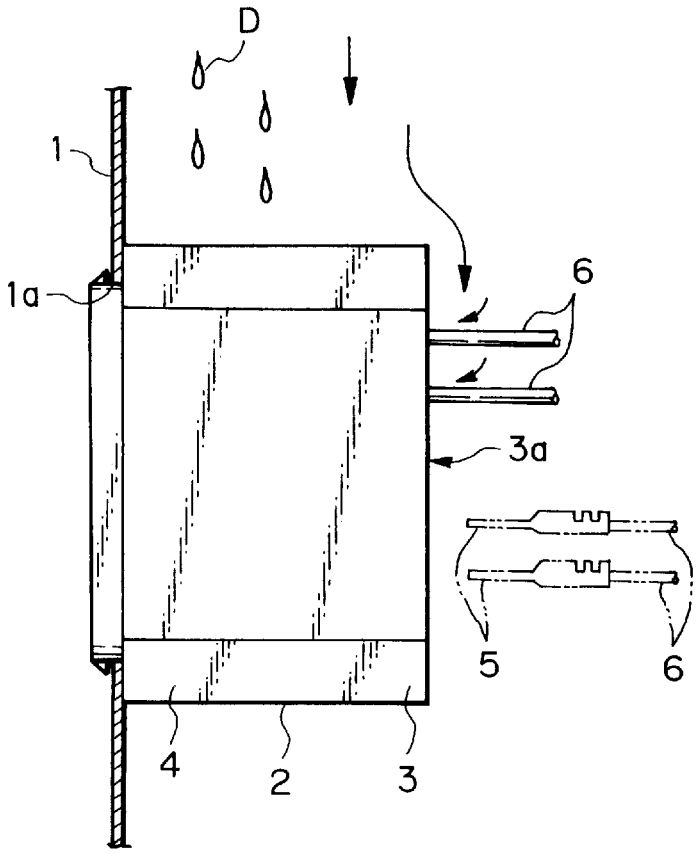
Fig. 6 PRIOR ART
FIG. 6 is a side elevational view of the panel connector shown in FIG. 5, illustrating a state in which the connector is attached to a car body panel.

In addition, if the rib 14 is formed into a trough-like configuration, as shown in FIG. 3, the water scarcely flows over the rib 14 on the edge of the visor 13 and thus no water drops onto the electric wires 20. Also, if several slant ribs 14*a* are provided on the hood portion 12 and visor 13, as shown in FIG. 4, the water will flow on the center part of the hood portion 12. The water, however, will not enter the terminal containing chamber 11*a*, since there is no through hole in the center part of the hood portion 12.

Since the connector housing 10 having the terminal containing chamber 11*a* which is open at the rear side is provided with the visor 13 which extends from the upper surface of the housing to the rear side so as to cover the space above the upper part of the opening of the chamber 11*a*, water drops cannot fall on the electric wires 20 drawn out of the terminal containing chamber 11*a* and thus cannot enter the terminal containing chamber 11*a*.

What is claimed is:

1. A connector comprising a front end portion, a rear end portion, an upper surface, a lower surface, and two laterally spaced apart side walls extending between said lower surface and said upper surface thereby defining a hollow interior, said interior having a rear opening with a terminal receiving portion adjacent thereto, said terminal receiving portion adapted to receive at least one terminal, said at least one terminal being connected to an electrically conductive wire at a rear end thereof adjacent said rear opening, said at least one terminal being adapted to receive a mating terminal at said front end portion remote from said rear end portion, a visor on said upper surface extending from adjacent said front end portion rearwardly to beyond said rear end portion, said visor having a trough adjacent said front end portion, whereby liquid contacting said visor is substantially prevented from entering said rear opening and contacting said wire.

2. The connector of claim 1 wherein said trough extends down said side walls.

3. The connector of claim 1 wherein said trough is a ridge upstanding from said upper surface and said side walls.

4. The connector of claim 1 wherein said trough is partially a ridge upstanding from said upper surface and said side walls.

5. The connector of claim 1 wherein said top surface is laterally rounded, whereby said liquid flows into said trough.

* * * * *